US006102400A

United States Patent [19]

Scott et al.

[11] Patent Number: 6,102,400

[45] Date of Patent: Aug. 15, 2000

[54] METHOD OF PLAYING A KENO GAME WITH A BONUS PAYOUT

[75] Inventors: Mark Scott, Las Vegas, Nev.; Bruce Henderson, Carefree, Ariz.

[73] Assignee: Bad Beat Gaming, LLC, Carefree, Ariz.

[21] Appl. No.: 09/173,484

[22] Filed: Oct. 14, 1998

Related U.S. Application Data

[60] Provisional application No. 60/064,670, Oct. 14, 1997.

[51] Int. Cl.[7] ..... A63F 3/06

[52] U.S. Cl. ..... 273/269; 273/138.1; 273/139; 463/18

[58] Field of Search ..... 273/269, 292, 273/143 R, 274, 306, 309, 138.1, 139; 463/18, 19, 20, 26, 27

[56] References Cited

U.S. PATENT DOCUMENTS

| | | | |
|---|---|---|---|
| 4,570,934 | 2/1986 | Smyth | 273/143 R |
| 4,669,731 | 6/1987 | Clarke | 273/143 R |
| 4,861,041 | 8/1989 | Jones et al. | 273/292 |
| 5,078,405 | 1/1992 | Jones et al. | 273/309 |
| 5,487,547 | 1/1996 | Hobert | 273/274 |
| 5,538,252 | 7/1996 | Green | 273/306 |
| 5,586,766 | 12/1996 | Forte et al. | 273/309 |
| 5,685,774 | 11/1997 | Webb | 463/13 |
| 5,695,402 | 12/1997 | Stupak | 463/20 |

OTHER PUBLICATIONS

Scarne's New Complete Guide to Gambling, by John Scarne, copyright 1961, 1974, IBSN: 0–671–21734–8; 0–671–63063–6 Pbk., pp. 205–219, 259–298, 342–365, 393–407, 490–499.

"Mills Futurity Bell Machine: Produced between 1936 and 1941", Slots 1 by Richard M. Bueschel, p. 136, 1978.

"Blackjack introduced at Table Mountain" by Royal Calkins, The Fresno Bee, Nov. 10, 1992.

*Primary Examiner*—Benjamin H. Layno

[57] ABSTRACT

In connection with the play of conventional keno games, both live keno games and mechanical or electronic keno gaming machines, the player is provided with the opportunity to win a "bad beat" bonus payout. The player uses a single keno ticket, and may be required to make an optional side bet wager to be eligible for the "bad beat" bonus payout or the player may be eligible simply by participating in the conventional keno game. If the player is "jackpot qualified" and the player plays at least five consecutive games of keno using the same keno ticket, the player wins a special payout.

4 Claims, 4 Drawing Sheets

| | | | | | | | | | |
|---|---|---|---|---|---|---|---|---|---|
| 1 | 2 | 3 | 4 | **5** | 6 | 7 | 8 | 9 | 10 |
| 11 | 12 | 13 | 14 | 15 | 16 | 17 | 18 | 19 | 20 |
| 21 | 22 | 23 | **24** | 25 | 26 | 27 | **28** | 29 | 30 |
| 31 | 32 | 33 | 34 | 35 | 36 | 37 | 38 | 39 | 40 |
| KENO | | | | | | | | | |
| 41 | 42 | 43 | 44 | 45 | 46 | 47 | 48 | 49 | 50 |
| 51 | 52 | 53 | **54** | 55 | 56 | 57 | 58 | 59 | 60 |
| 61 | 62 | 63 | 64 | 65 | 66 | 67 | **68** | 69 | 70 |
| 71 | **72** | 73 | 74 | 75 | 76 | 77 | 78 | 79 | 80 |

FIG—3

METHOD OF PLAYING A KENO GAME WITH A BONUS PAYOUT

CROSS-REFERENCE TO RELATED APPLICATIONS

This application is based on and is a Continuation-in-Part of Application Serial No. 60/064,670, filed Oct. 14, 1997, entitled "Bad Beat Stud", now pending.

This application relates to a casino card games, and more particularly to a casino card games in which a player has the opportunity to receive a special "bad beat" payout when he suffers a losing hand. These "bad beat" payouts can be applied to many traditional casino games such as Twenty-One, craps, keno, bingo, electronic video poker games and slot machines.

BACKGROUND OF THE INVENTION

Seven card stud poker has been played for many years. Each player receives seven cards and makes the best five card poker hand from these seven cards. The ranking of poker hands in seven card stud uses conventional poker hand rankings: Royal Flush, Straight Flush, Four-of-a-Kind, Full House, Flush, Straight, Three-of-a-Kind, Two Pair, One Pair and Highest Card.

Poker games using community cards have also been played for many years. These games generally fall into the family of games known as "Spit-in-the-Ocean" games. In these games each player is dealt one or more cards and the rest of the player's hand comes from community cards available to all players.

Perhaps the most popular community card game is Texas Hold-Em because of the large number of players who can play at one time and the fast action and large pots that are generated. The game is fast because only two cards are dealt to each player, with the remaining cards being dealt to a "flop" which forms the community cards from which each player makes up the rest of his hand. Each hand, however, has a single set of community cards which all players use as part of their poker hand. Therefore, the winning hand comes from that player whose two cards best fit with the community cards.

There are also many casino games which add to the conventional game an additional side bet so that a player can be eligible for a large jackpot. In CARIBBEAN STUD® Poker, a player can make a separate side bet wager to be eligible for special payouts. If the player has made the side bet wager and is dealt a Royal Flush, the player wins 100% of a progressive jackpot amount. This side bet feature is described in U.S. Pat. No. 4,861,041, the disclosure of which is incorporated herein. As described in this '041 patent, this side bet feature can also be applied to Twenty-One, conventional Draw Poker and other casino games.

In live poker room gaming, a plurality of players compete against one another. The house or game operator provides a dealer, the cards and a table to play the game. Typically, a small percentage of each pot (the "rake") is collected by the game operator as the fee for providing the dealer and the facilities.

Operators of live poker room gaming have used different types of inducements to encourage player participation. Besides free coffee and donuts, many operators also provide what is known as a "bad beat" jackpot. The operator makes a payment to a player who has an unusually high ranking poker hand, but loses the pot to another player with an even higher ranking poker hand.

In a typical "bad beat" jackpot situation, the operator of the poker room seeds a jackpot at some beginning level amount, say $1,000.00. The jackpot can remain as a fixed amount until won by a player or the jackpot can be a progressive amount which increases each hour or day until won.

The progressive jackpot can also increase based on the amount of play occurring at the poker table. For example, a portion of the "rake" can be used by the operator to increase the progressive amount of the "bad beat" jackpot.

In order to win the "bad beat" jackpot, a player must have a high ranking poker hand, but lose the regular game pot to another player. Typically, to be eligible for the "bad beat" jackpot, a player must have at least Aces Full of Tens (a Full House with three Aces and two Tens or better) and then lose the regular pot. Even though the player may have lost the regular pot, the player wins the "bad beat" jackpot which could be several thousand dollars. Often this "bad beat" jackpot is divided among all of the players at the table, with the player holding the "bad beat" hand winning the major portion of the jackpot.

This "bad beat" feature has been a popular addition to live card room poker games and players are attracted to the card room to participate in the various card games played there when a "bad beat" jackpot is available. As casino gaming proliferates throughout the United States and into foreign countries, there continues to be a need to attract and keep the interest of the players in all forms of casino gaming. It is proposed in this invention to create a "bad beat" feature that can be used in connection with many of the conventional casino games, such as Twenty-One, craps, keno, bingo, electronic video poker games and slot machines.

It is the object of the present invention to provide a "bad beat" feature as an adjunct to conventional casino games in either live game format or as played on mechanical or electronic video gaming machines. Among those casino games to which a "bad beat" feature can be added are Twenty-one, craps, keno, bingo, electronic video poker games and slot machines.

It is a feature of the present invention that a player is offered the opportunity to win or share in a "bad beat" bonus payout whenever a pre-established event or series of events occurs during the play of the casino game. The player may be automatically eligible for this "bad beat" bonus payout by simply playing the casino game or the player may be required to make an additional wager to be eligible to receive the "bad beat" bonus payout.

It is an advantage of the present invention that the "bad beat" bonus payouts will add new and exciting features to conventional casino games and will increase player participation and add to the enjoyment of the casino game experience. The "bad beat" feature also provides the player with the opportunity to win a large jackpot amount in a situation such as where the player would otherwise have only a losing hand.

SUMMARY OF THE INVENTION

In connection with the play of conventional casino games, both live casino games and mechanical or electronic gaming machines, the player is provided with the opportunity to win a "bad beat" bonus payout. These conventional casino games include Twenty-One, craps, keno, bingo, electronic video poker games and slot machines.

The player may be required to make an optional side bet wager to be eligible for the "bad beat" bonus payout or the player may be eligible simply by participating in the conventional casino game. For example, if the player is "jackpot qualified" and the player has a predetermined poker hand ranking, the player wins a special payout. The "bad beat" bonus payout can take the form of the player winning a preselected or progressive payout amount for certain pre-established events happening during the play of the game.

BRIEF DESCRIPTION OF THE DRAWINGS

FIG. 3 shows a keno ticket that can be used by a player to play a plurality of consecutive keno games in the keno bad beat feature of the present invention.

DETAILED DESCRIPTION OF THE PREFERRED EMBODIMENTS

The method of the present invention involves a seven card stud poker game combined with an optional side bet involving a "bad beat" feature. The object of the method of play is for each player to beat the dealer's hand. Each player and the dealer play a seven card stud poker hand. Each player and the dealer are dealt separate five card hands. Two community cards, the "turn" card and the "river" card, are used by all players and the dealer to complete the seven card hands. Each player and the dealer use the best five card poker hand of the total seven cards.

The "bad beat" feature comes into play when a player achieves a high ranking poker hand, but still loses to the dealer. When the player has a high ranking poker hand and suffers this "bad beat", the player wins all or a predesignated portion of a jackpot amount depending on the ranking of the poker hand held by the player. The jackpot amount can be either a fixed jackpot amount or a progressive jackpot amount.

Figure 1:
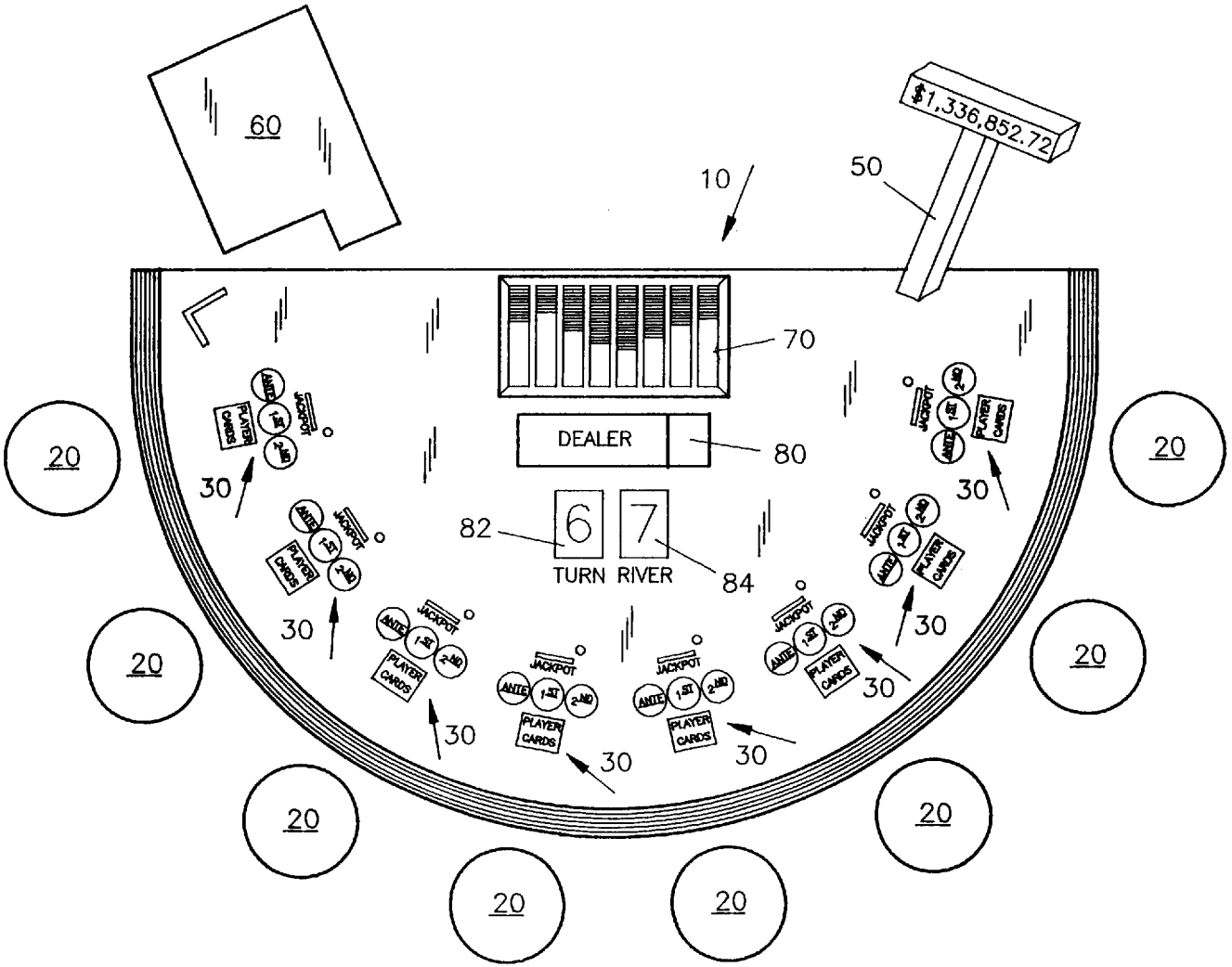
FIG. 1 shows the table layout used in the method of the play of the present invention.
Figure 2:
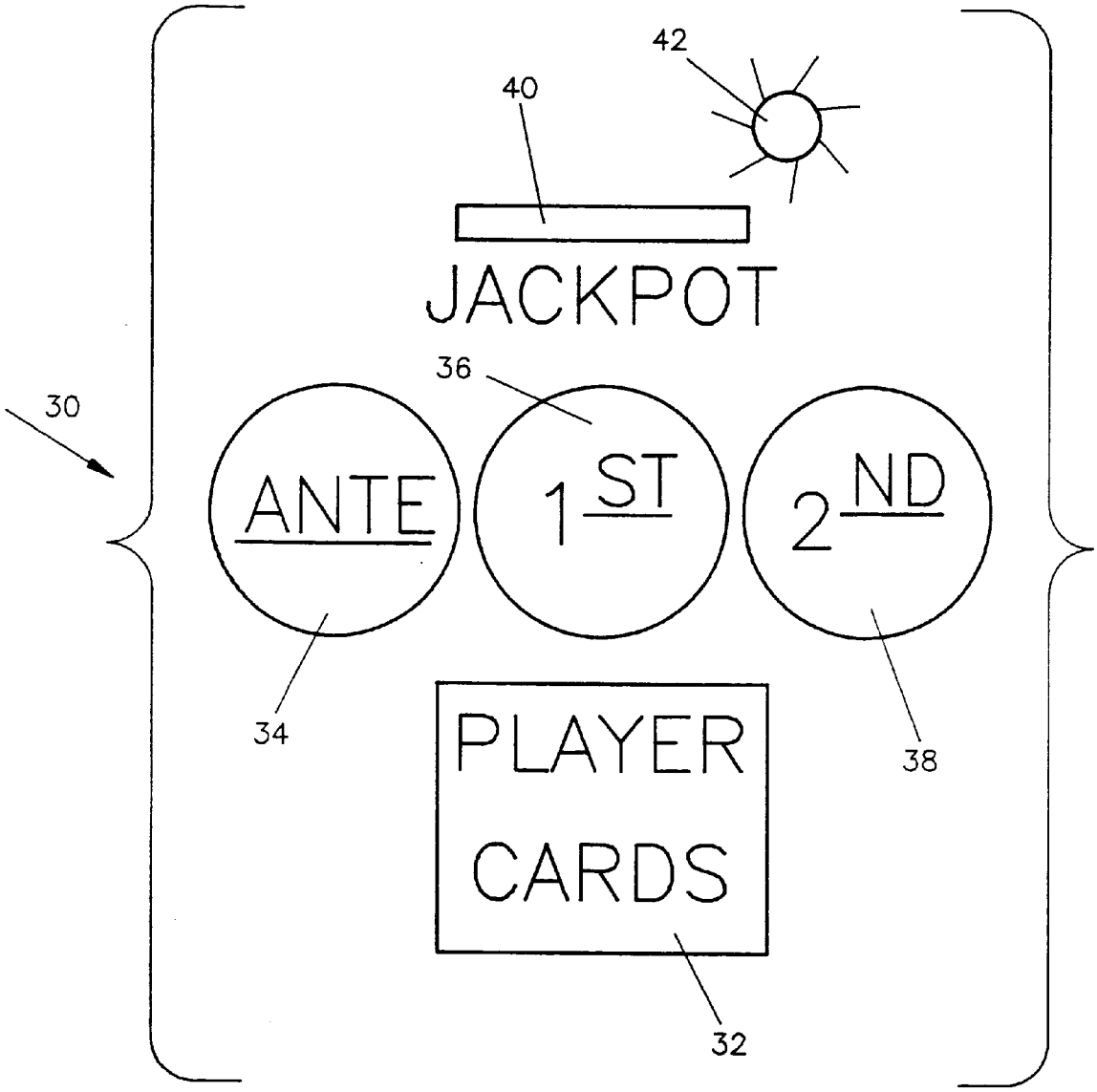
FIG. 2 shows an enlarged detail view of the table layout at a particular player location.

The seven card stud poker game is preferably played at a gaming table layout of the type shown generally at 10 in FIG. 1. A plurality of player positions 20 are located around the periphery of a semi-circular gaming table of the type used for live table gaming, such as a Twenty-One table. Each player position 20 has a wagering location 30 associated therewith, the details of each wagering location being shown in FIG. 2.

Each wagering position includes a "playercards" area 32 and three wagering areas—the "ante" spot 34, the "first" wager spot 36 and the "second" wager spot 38. Also included at each wagering location is the "jackpot" wager location 40 which is used by the player to make a side wager to be eligible for the "bad beat" feature of the method of play. Any suitable device can be used for the "jackpot" wager location 40 such as a slot in the surface of the gaming table to receive the side wager for the "bad beat" feature. An illumination device 42, such as an LED, can be associated with the slot to show that the player at that position has made a side wager to be eligible for the "bad beat" feature. A typical apparatus that can be used for the side wager is shown in U.S. Pat. No. 5,078,045, which is incorporated herein by this reference.

Referring again to FIG. 1, also positioned at a suitable location on the gaming table is a progressive meter sign 50 that shows the current amount of the progressive jackpot that is available to be won by a lucky player. Also optionally associated with the gaming table 10 is a card shuffling device 60 for shuffling the cards prior to each deal.

The gaming table layout also has a dealer position located adjacent to the chip rack 70 which is conventional. The dealer location also includes a location 80 for displaying the dealer's first five cards. Positioned adjacent the location 80 are two additional card positions, the "turn" card position 82 and the "river" card position 84, the use of which will be described below.

The method of play of the present invention proceeds as follows:

Each player makes an initial ante wager to be eligible to play the game. The player places his ante wager amount in the "ante" spot 34 on the gaming table layout. Each player also has the option to make a side bet wager to be eligible for the "bad beat" feature. The player makes this side bet wager by placing a gaming token in the slot 40 at his player position. When the gaming token is inserted into the slot 40, the LED 42 lights up to show that the player has made the side bet wager.

After each player has made his ante wager and his side bet wager, the dealing of the cards begins. Using a standard deck of fifty-two playing cards which have been shuffled in any conventional manner, the dealer deals five cards to each player and five cards to the dealer's position. The deal can be performed in any suitable manner such as one card at a time to each player followed by a card to the dealer's position until all five cards have been dealt. Alternatively, each player can be dealt all five cards at once, proceeding around the table until all players have been dealt their five cards and then the dealer's position receives its five cards. The deal is preferably performed from the dealer's left-to-right around the table, as in conventional, but any direction of the deal can be used.

Each player receives his cards face down and the dealer's cards are placed face down at the dealer position. Finally, two other face down cards are dealt and placed at the "turn" position 82 and the "river" position 84, respectively. Each player looks at his cards and decides whether to proceed with the game. The dealer's cards remain face down on the table layout at the location 80.

After looking at his five cards, each player must then decide whether to fold and lose his ante or continue to play by making another wager which is placed in the "first" wager spot 36 at the player location. After all players have either folded or made the "first" wager, the "turn" card 82 is revealed.

Each player must then decide whether to fold and lose his ante wager and his first wager, or to continue playing by making another wager, which is placed in the "second" wager spot 38 at the player location. After all players have either folded or made the "second" wager, the "river" card 84 is revealed. At this time, also, all of the dealer's initial five cards are turned face up.

Both the "turn" card 82 and the "river" card 84 are community cards that are used by each player and the dealer. Thus each player and the dealer have seven card stud poker hands from which the best five cards are used to make the highest ranking poker hand possible. Conventional poker hand rankings are used.

Before each player's hand is compared to the dealer's hand, each player's hand is analyzed to see if the player has a minimum qualifying hand. In order for the player's hand to qualify, the player must have a minimum ranking hand which is to be determined mathematically. In the preferred embodiment of the present invention, the minimum ranking poker hand for qualifying will be at least a pair of Deuces or better in the seven cards used in the player's hand. Alternatively, other lower or higher ranking poker hands can be used as the minimum qualifying poker hand ranking for the player's hand to qualify.

If the player does not have a minimum qualifying hand, all wagers (except the side bet wager) made by each player are lost to the gaming establishment including the "ante" wager, the "first" wager and the "second" wager.

If the player does qualify, all cards of each player's hand are turned face up and each player's hand is compared to the dealer's hand to determined whether the player's hand has a higher ranking five card poker hand than the dealer's hand. The two community cards are used in all hands to determine each hand's best five card poker hand ranking. Conventional poker hand rankings are used to determine the higher hand: Royal Flush, Straight Flush, Four-of-a-Kind, Full House, Flush, Straight, Three-of-a-Kind, Two Pair and One Pair.

As an alternative to using a player hand qualification, a dealer hand qualification may be used. In this variation, before each player's hand is compared to the dealer's hand, the dealer's hand is analyzed to see if the dealer has a minimum qualifying hand. In order for the dealer's hand to qualify, the dealer must have a minimum ranking hand which is to be determined mathematically. In the preferred embodiment of the present invention, the minimum ranking poker hand for qualifying will be at least a pair of Jacks or better in the seven cards used in the dealer's hand. Alternatively, other lower or higher ranking poker hands can be used as the minimum qualifying poker hand ranking for the dealer's hand to qualify.

If the dealer does not have a minimum qualifying hand, all wagers (except the side bet wager) made by each player are considered pushes and returned to the player including the "ante" wager, the "first" wager and the "second" wager.

If the dealer does qualify, the game continues, All cards of each player's hand are turned face up and each player's hand is compared to the dealer's hand to determined whether the player's hand has a higher ranking five card poker hand than the dealer's hand. The two community cards are used in all hands to determine each hand's best five card poker hand ranking. Conventional poker hand rankings are used to determine the higher hand: Royal Flush, Straight Flush, Four-of-a-Kind, Full House, Flush, Straight, Three-of-a-Kind, Two Pair and One Pair.

In either variation, if the dealer's hand wins, all wagers made by the player are lost (subject to the "bad beat" feature to be explained below). If the player's hand wins, the player wins one-to-one odds on each of his wagers—the "ante" wager, the "first" wager and the "second" wager. If the player's hand loses, the player loses all of his three wagers. If the player's hand and the dealer's hand tie, then all of the player's wagers are a push and all of the player's wagers are returned to the player.

After winning and losing player's hands are determined, the outcome of the side bet for either winning poker hand combinations or for the "bad beat" feature is considered. In order to be eligible to possibly win either one of these side bet payouts, the player must have made the side bet wager at the beginning of the play of the hand. When the player has made this side bet wager, the player is said to be "jackpot qualified." Additionally, the player must also have a "non-folded" hand, i.e. the player must have made all three wagers—the "ante" wager, the "first" wager and the "second" wager.

In the preferred embodiment of the present invention, the side bet wager will be in the amount of $1.00, but the method of play of the present invention can be adapted to any amount used as the side bet wager. In the preferred embodiment of the present invention, a percentage of each side bet wager is added to a progressive jackpot amount that is available to be won by the player who has a high ranking poker hand or when the player suffers a "bad beat" . It is also contemplated that the progressive jackpot will be initially seeded at a suitable beginning level amount, for example $100,000.00.

If the player is "jackpot qualified", then the player is eligible to win additional payouts on the poker hand ranking of his best five card hand. If the player's hand beats or ties the dealer's hand and the player's hand comprises at least a Four-of-a-Kind or better, then the player wins a payout based on the amount of the player's side bet. Table 1 shows a representative pay table for a $1.00 side bet wager for certain high ranking poker hands achieved by the player.

The other side bet for which the player is eligible when he is "jackpot qualified is the "bad beat" feature. The "bad beat" feature involves the situation in which the player has a high ranking poker hand and loses to the dealer's higher ranking poker hand.

If the player is "jackpot qualified" and loses to the dealer's hand and the player has a losing poker hand of one of certain predetermined poker hand rankings, the player wins a "bad beat" payoff based on the amount of the player's side bet wager, such as the $1.00 preferred wager. Although any predetermined poker hand rankings can be used for a consideration of the "bad beat" feature, in the preferred embodiment of the present invention, to be eligible for a "bad beat" payoff, the player must have at least a Straight and the player must lose to the dealer because the dealer has a poker hand with a ranking higher than the player's hand.

Table 1 shows a representative payout table that can be used for high ranking poker hands when the player wins or ties the dealer or when the player suffers a "bad beat" hand based on a $1.00 side bet wager.

TABLE 1

| Poker Hand Ranking | Win/Tie | "Bad Beat" |
|---|---|---|
| Royal Flush | $1,000 | N/A |
| Straight Flush | $200 | $500,000 |
| Four of a Kind (Aces thru Tens) | $100 | $100,000 |
| Four of a Kind (Nines thru Twos) | $50 | $50,000 |
| Full House | Lose | $500 |
| Flush | Lose | $100 |
| Straight | Lose | $50 |
| Other | Lose | Lose |

Other pay tables can be used with various winning amounts and poker hand ranking combinations.

For example, if the player has a Straight and loses to the dealer, the player is paid fifty times the amount of the player's side bet wager ($50 for a $1 side bet wager). Similarly, the player is paid one hundred times the amount of the player's side bet wager for a Flush "bad beat" loser and five hundred times the amount of the player's side bet wager for a Full House "bad beat" loser all the way up to five hundred thousand times the amount of the player's side bet wager for a Straight Flush "bad beat" loser.

As an additional feature of the present invention, in certain "bad beat" wager winning situations, all other players at the table who have also made the side bet wager will share in the amount of the "bad beat" winnings with the player who had the "bad beat" losing hand winning the major portion of the winnings.

The "bad beat" feature of the present invention, while described above in connection with a seven card stud game, can also be applied to other casino games, both live table games and mechanical or electronic video poker games and slot machines. In the preferred embodiment of the present invention as described in connection with each of the following examples, it is assumed that the player has a made an additional side bet wager to be eligible for the "bad beat" payouts. However, in an alternative embodiment of the present invention, the player can be eligible for the "bad beat" payout without having to make an additional wager, that is the player is eligible for the "bad beat" payout simply by participating in the conventional casino game.

Conventional Twenty-One (also known as Blackjack) has been played in gaming casinos for many years. Basically, Twenty-One involves playing a player's hand against a dealer's hand, with the winning hand having the highest numerical count not exceeding a numerical count of twenty-one. The basic method of play of Twenty-One is described in "Scarne's New Complete Guide to Gambling" at pages 342–365, copyright 1961, 1974, the disclosure of which is incorporated herein by this reference. As used in this specification and the accompanying claims, the "conventional manner of play of Twenty-One" includes both the basic method of play as well as any known variations thereof.

The "bad beat" modification of the present invention when applied to the conventional manner of play of Twenty-One could provide that player win a "bad beat" payout if the dealer has a Blackjack of the Ace of Spades and the King of Spades and the player has a Blackjack consisting of an Ace and a King suited of any of the three suits other than Spades. In other words, the player is awarded a "bad beat" payout if the player has a two card numerical count of twenty-one consisting of an Ace and a King suited other than the Ace of Spades and the King of Spades on the player's first two cards and a dealer has an Ace of Spades and a King of Spades on the dealer's first two cards.

In one embodiment of this "bad beat" feature as applied to a Twenty-One game, the player is eligible for a "bad beat" payout whenever he has made a normal Twenty-One wager or the player could be required to make an additional side bet wager at the beginning of each hand. The player is dealt his first two cards and the dealer is dealt his first two cards. If the dealer's first two cards are the Ace of Spades and the King of Spades and the player's first two cards are a suited Ace and King, then the player wins the "bad beat" payout which can be either a fixed amount or a progressive jackpot amount.

In another embodiment of this "bad beat" feature as applied to a Twenty-One game, the player is dealt his first two cards and the dealer is dealt his first two cards. The dealer's first two cards are dealt one card face up and one card face down as is conventional. If the dealer's face up card is either the Ace of Spades or the King of Spades, the player has the option of making a second side bet (whether or not the player has made the first side bet for the other "bad beat" feature) in an amount equal to or less than the amount of the player's wager on the conventional Twenty-One hand. If the dealer then has both the Ace of Spades and the King of Spades as the dealer's first two cards, the player can be paid predetermined odds on the amount of the player's second wager. The odds can be any appropriate amount, for example 40-to-1.

Conventional video poker games typically uses only a single player's hand to determine winning and losing plays. The player is dealt five cards and is allowed to discard any of his initial five cards and receive replacement cards for the discarded five cards. The poker hand ranking of the player's final five cards is used to determine winning and losing hands. Typically, the player must have at least a Pair of Jacks or Better to have a winning hand. The amount won by the player is determined by the poker hand ranking of the player's final five card hand and the amount of the player's wager. A pay table shows the winning combinations and the amount that can be won by the player.

In order to provide a "bad beat" payout to the conventional manner of play of video poker, a dealer's hand is added to the method of play to provide a situation in which the player can suffer a "bad beat". In one example of carrying out this embodiment, the player is dealt his initial five card hand face up and a five card dealer's hand is dealt face down. The player plays his hand by drawing and discarding as is conventional in video draw poker and the player ends up with a final five card hand having a poker hand ranking. The dealer's five hand is then turned face up.

In one version of this invention, the dealer's face up is five card hand is compared to the player's final five card hand and if the player has a "bad beat" hand compared to the dealer's hand, then the player can win a "bad beat" payout. In another version of this invention, the dealer's hand is played out by discarding and drawing replacement cards in an attempt to improve the poker hand ranking if the dealer's hand and the dealer's final five card hand is compared to the player's hand to determine whether the player has suffered a "bad beat" hand.

For example in either version, if the player achieves at least a Flush hand, and the dealer's hand is a higher hand, the player can be awarded a "bad beat" payout. The amount of the "bad beat" payout is shown in a pay table and is based on the comparison of the dealer's poker hand ranking and the player's poker hand ranking. Any suitable pay table can be used, for example the pay table shown in Table 1 can also be used in connection with this "bad beat" feature. The basic method of play of Craps is described in "Scarne's New Complete Guide to Gambling" at pages 259–298, copyright 1961, 1974, the disclosure of which is incorporated herein by this reference. As used in this specification and the accompanying claims, the "conventional manner of play of Craps" includes both the basic method of play as well as any known variations thereof.

Craps is a dice game using two dice and the players make various wagers dependent on the outcome of the roll of the dice. In a Craps game, a "bad beat" proposition could be provided for a player based on having made a point and then losing the point (Crapping Out) a pre-established number of times in a row, for example, five times in a row.

In a conventional slot machine, the player wagers one or more coins, tokens or credits and pulls the handle of the slot machine to activate the reels to spin. Many conventional slot machines have a single horizontal pay line, but the windows through which the a player can observe the spinning reels are typically large enough that a horizontal line both above and below the pay line is visible to the player. Thus, when the reels stop spinning, the player can observe the symbols that have come to a stop on the center pay line and the player can also observe the symbols that are aligned on the horizontal line above the pay line and on the horizontal line below the pay line. These conventional slot machines also have a special symbol on each reel of the slot machine that denotes the largest payout available on that slot machine. Usually this special symbol for the largest payout is a "7" but other symbols can be used to designate the largest jackpot. The player usually needs to line up three or more of these special symbols on the center pay line to win the largest payout.

A "bad beat" payout could be made if this special winning symbol on the slot machine is aligned on each reel immediately above or on each reel immediately below the center pay line.

The basic method of play of Keno is described in "Scarne's New Complete Guide to Gambling" at pages 490–499, copyright 1961, 1974, the disclosure of which is incorporated herein by this reference. As used in this specification and the accompanying claims, the "conventional manner of play of Keno" includes both the basic method of play as well as any known variations thereof.

In a conventional Keno game, twenty numbers are drawn from a pool of eighty possible numbers. A player selects from one up to fifteen numbers as the numbers the player desires to be drawn during a round of the play of the game. The player marks on a Keno ticket the particular numbered spots that the player wishes to be his numbers for the Keno game. The player wins or loses depending on how many of his selected numbers are drawn and the amount won by the player is based on the amount wagered by the player and the number of "hits" that the player achieves. Players may also play two or more consecutive games of Keno by marking a single Keno ticket and making wagers for a series of consecutive games.

In order to provide a "bad beat" payout to a conventional Keno game, the player would be paid a "bad beat" payout if the player fails to hit a single number on a five game ticket having at least six spots marked.

Figure 4:
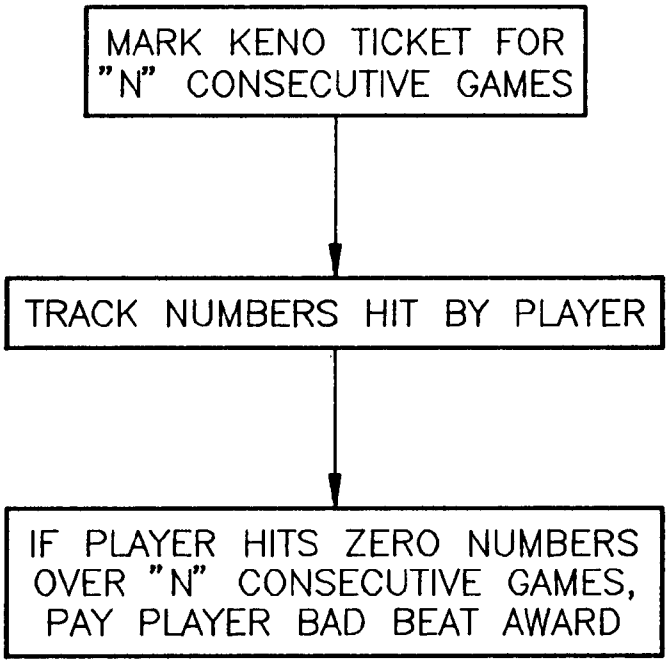
FIG. 4 shows a flow chart of the method of play of the keno bad beat feature of the present invention.

FIG. 3 shows a keno ticket that has been marked with six spots. FIG. 4 shows a flow chart of the method steps of this bad beat keno feature.

The basic method of play of Bingo is described in "Scarne's New Complete Guide to Gambling" at pages 205–219, copyright 1961, 1974, the disclosure of which is incorporated herein by this reference. As used in this specification and the accompanying claims, the "conventional manner of play of Bingo" includes both the basic method of play as well as any known variations thereof.

Bingo is traditionally played using a bingo card having a five-by-five matrix with a "free space" as the center spot. In order to win the Bingo game, the player must achieve a particular pattern on his bingo card during the play of a round of Bingo. One of the popular types of Bingo games is the coverall (or blackout) game in which all of the numbers on a player's bingo card must be drawn in order for the player to win.

In order to add a "bad beat" payout to a Bingo game, the player would be paid a "bad beat" payout if the player has six or less bingo numbers marked on his bingo card as drawn numbers at the time some other player achieves a coverall (or blackout) in such a game. For example, a sliding payout schedule can be devised that pays the player different amounts based on the amount of bingo numbers that the player has covered when another player achieves a coverall. In one embodiment, a player could receive one free game of bingo for having either five or six numbers covered, three free games of bingo for having either three or four numbers covered, a $100 payout for having one or two numbers covered and the "bad beat" payout jackpot (which can be either a fixed amount or a progressive amount) for having zero numbers covered when another player achieves a coverall.

The method of the present invention has been described in connection with a live casino table game. The invention may also be practiced using an electronic gaming machine programmed to display the method of play on a video screen.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of including a bad beat payout during the conventional manner of play of a game of Keno using a single Keno ticket in which the player is playing at least five consecutive games of Keno using the same Keno ticket and the player has marked at least six spots on his Keno ticket for each of the five consecutive games comprising:

a) a player participating in the conventional manner of play of the game of Keno; and b) awarding the player a bad beat payout if the player fails to hit a single spot on his Keno ticket during all of the five consecutive games of Keno.

2. The method of claim 1 in which the player is required to make a separate wager to be eligible for the bad beat payout.

3. A method of including a bad beat payout during the conventional manner of play of a game of Keno using a single Keno ticket in which the player is playing at least a predetermined number of consecutive games of Keno using the same Keno ticket and the player has marked at least a pre-established number of spots on his Keno ticket for each of the predetermined number of consecutive games of Keno comprising:

a) a player participating in the conventional manner of play of the games of Keno; and b) awarding the player a bad beat payout if the player fails to hit a single spot on his Keno ticket during all of the predetermined number of consecutive games of Keno.

4. The method of claim 3 in which the player is required to make a separate wager to be eligible for the bad beat payout.

* * * * *